US009168576B2

(12) United States Patent
Unan

(10) Patent No.: US 9,168,576 B2
(45) Date of Patent: Oct. 27, 2015

(54) TOWER PRODUCTION METHOD

(75) Inventor: Cevdet Unan, Ankara (TR)

(73) Assignee: Uztek Endustri Tesisleri Insaat Imalat Ve Montaj Sanayi Ve Ticaret Limited Sirketi, Ankara (TR)

( * ) Notice: Subject to any disclaimer, the term of this patent is extended or adjusted under 35 U.S.C. 154(b) by 99 days.

(21) Appl. No.: 14/113,948

(22) PCT Filed: May 27, 2011

(86) PCT No.: PCT/EP2011/058768

§ 371 (c)(1),
(2), (4) Date: Oct. 25, 2013

(87) PCT Pub. No.: WO2012/146317

PCT Pub. Date: Nov. 1, 2012

(65) Prior Publication Data

US 2014/0047696 A1 Feb. 20, 2014

(30) Foreign Application Priority Data

Apr. 27, 2011 (TR) ..... a 2011 04141

(51) Int. Cl.

| | |
|---|---|
| ***B21C 47/02*** | (2006.01) |
| ***B21C 37/12*** | (2006.01) |
| ***B21C 37/18*** | (2006.01) |
| ***B21C 37/15*** | (2006.01) |

(52) U.S. Cl.

CPC ..... *B21C 47/02* (2013.01); *B21C 37/122* (2013.01); *B21C 37/124* (2013.01); *B21C 37/126* (2013.01); *B21C 37/15* (2013.01); *B21C 37/185* (2013.01); *Y10T 29/49631* (2015.01); *Y10T 29/49826* (2015.01)

(58) Field of Classification Search

CPC ..... B21C 47/02; B21C 37/15; B21C 37/126; B21C 37/122; B21C 37/124; B21C 37/185; Y10T 29/49631; Y10T 29/49826

See application file for complete search history.

(56) References Cited

U.S. PATENT DOCUMENTS 2,751,672 A * 6/1956 Reed ..... 29/429
3,888,283 A * 6/1975 Cauffiel ..... 138/150

(Continued)

FOREIGN PATENT DOCUMENTS

DE 14 52 253 A1 1/1969
JP 58 070918 A 4/1983

OTHER PUBLICATIONS

PCT Search Report dated Jan. 19, 2012 of Patent Application No. PCT/EP2011/058768 filed May 27, 2011.

*Primary Examiner* — Moshe Wilensky
(74) *Attorney, Agent, or Firm* — Maine Cernota & Rardin

(57) ABSTRACT

A tower (C) production method is developed with the present invention, comprising a first production stage including the steps of unrolling and bringing into a planar state a sheet metal (B) wound around a coil (A); bending the planar sheet metal (B) at the lateral direction at varying bending radii (d); and winding the bent sheet metal (B') into a conical coil (A'), as well as a final production stage yielding the tower and including the steps of feeding the sheet metal (B') unwound from the conical coil (A') to at least one winding machine (8), and bending and winding the bent sheet metal (B') in the winding machine around a central bending axis (T) parallel to one surface (B1) thereof so that a defined initial winding radius and the angle between a longer edge (B3) thereof and the axis (T) are kept constant and the longer edge (B3) of the sheet metal is joined over itself.

11 Claims, 4 Drawing Sheets

(56) References Cited

U.S. PATENT DOCUMENTS 6,336,583 B1 * 1/2002 Wang et al. ..... 228/175
7,037,388 B2 * 5/2006 Kan et al. ..... 148/332
2002/0114884 A1 * 8/2002 Friedersdorf et al. ..... 427/195
2010/0095508 A1 4/2010 Wahlen et al.

* cited by examiner

TOWER PRODUCTION METHOD

RELATED APPLICATIONS

This application is a national phase application filed under 35 USC §371 of PCT Application No. PCT/EP2011/058768 with an International filing date of May 27, 2011, which claims priority of TR 2011/04141 filed Apr. 27, 2011. Each of these applications is herein incorporated by reference in their entirety for all purposes.

TECHNICAL FIELD

This invention relates to a production method of towers employed in wind turbines.

PRIOR ART

Diminishing fossil fuel resources and rising environmental pollution have turned the tendency towards clean energy resources into a need. Clean energy resources are those resources which do not bring about any emission of carbonaceous compounds when used. One of these most known and mostly preferred resources is the wind energy.

This energy source, the so-called wind energy, is obtained basically by turning the kinetic energy of wind into an exploitable form by means of turbines (mechanical turbine rotors). This mechanical energy is widely converted into electrical energy by means of electrical generators. The turbines are preferably disposed on towers at a plane which is vertical to the towers.

Since the wind speed increases with an increasing elevation from the sea level, the amount of energy obtainable from the wind enhances with rising the length of a tower. This mechanical effect generated by the wind, however, likewise influences the tower that carries the turbine. For this reason, it becomes crucial to provide the towers with a robust structure and to render them compliant with the operational conditions.

Towers of various structures have been in use for turbines. One of the most commonly used towers is the lattice-type tower. In the lattice type, the tower is composed of vertical or near-vertical bearing members and bracing elements coupling these members together. The lattice structure is advantageous for the production of lighter and robust towers with lower air resistance. On the other hand, since the lattice structure provides an open structure, any devices or equipment disposed within the lattice become exposed to external influences. Additionally, since the lattice structure allows birds to settle thereon, the revolving turbines generally cause the death of birds. And finally, as pointed above, the fact that the lattice structure is open against external influences brings about difficulties for the maintenance work in the tower and prolongs and endangers the same.

Therefore, close-structure turbine towers are preferred in wind turbines due to the drawbacks referred to hereinabove. One type of tower widely used in closed-type towers is the conical tower. In conical towers, the towers have a circular cross-section and therefore suffer lower air resistance. This circular cross-section also ensures a uniform distribution of tensile and compressive forces directed to the base of the tower. Since conical towers have a closed structure, they do not show the drawbacks encountered in lattice towers. Since the cross-sectional radius of the tower decreases with the length of the tower increasing, the strength of the tower suffices against the increasing wind speed at higher elevations.

The conical towers are manufactured in various forms. The most common method known in the prior art comprises the production of the lateral surface of a tower structure by cutting sheet metals of defined sizes in a proper manner, and bending and joining the same. However, the entirety of these operations cannot be performed at a single production site. Since such a tower is produced as a result of the joining operation that is too large to be transported, it becomes indispensable to conduct this operation at the site of installation. Preferably, the tower is produced in the form of components with horizontal upper and lower bases and these components are assembled at the production site. In this production method, however, almost half of the sheet metals used are cut and so become waste.

It is necessary to shape a web of sheet metal, i.e. a sheet metal coil, before it is cut in order to avoid material wastes and production handicaps. In the patent document JP 58/70918 A, in which a continuous conical structure production technique is disclosed, while a web of sheet metal is rolled with bending rollers, the angle between the line indicating the direction of movement of the sheet metal and the normal of the base of the tower is changed to yield a conical form. In that production method, however, it is not possible to produce wind turbines produced from thicker materials.

For the aforementioned reasons, a heretofore unaddressed need exists in the industry to develop a production method which eliminates such drawbacks.

BRIEF DESCRIPTION OF INVENTION

The tower production method developed with the present invention comprises a first production stage including the steps of unrolling and bringing into a planar state a sheet metal wound around a coil; bending the planar sheet metal at the lateral direction at varying bending radii; and winding the bent sheet metal into a conical coil, as well as a final production stage yielding the tower and including the steps of feeding the sheet metal unrolled from the conical coil to at least one winding machine, and bending and winding the bent sheet metal in the winding machine around a central bending axis parallel to one surface thereof so that a defined initial winding radius and the angle between a longer edge thereof and the axis are kept constant and the longer edge of the sheet metal is joined over itself.

With the production method developed, the production stages of a tower and particularly of a conical tower are divided into two and the preproduction of the material composing the tower is performed at a plant. Following the first stage, the material that is turned into a coil is easily transported to the site of final production with lower costs and the final production stage is performed at the site to complete the tower production process. Thus, it becomes possible to produce towers of larger sizes while lowering production costs.

OBJECT OF INVENTION

The object of the present invention is to develop a tower production method for a conical tower.

Another object of the present invention is to develop a tower production method, making use of a web of sheet metal, i.e. sheet metal coil.

A further object of the present invention is to develop a tower production method, allowing for a continuous production process.

Still another object of the present invention is to develop a tower production method, which allows for easier transportation than prior art methods.

Yet another object of the present invention is to develop a tower production method allowing production of a tower with higher mechanical strength than prior art towers.

Still a further object of the present invention is to develop a tower production method that minimizes waste material.

Yet a further object of the present invention is to develop a method for producing an inexpensive tower, which is easily produced, transported, and assembled.

DESCRIPTION OF FIGURES

A system, in which is used a tower production method developed according to the present invention, as well as representative embodiments of towers produced according to this method are illustrated in the annexed figures briefly described as following.

Figure 1:
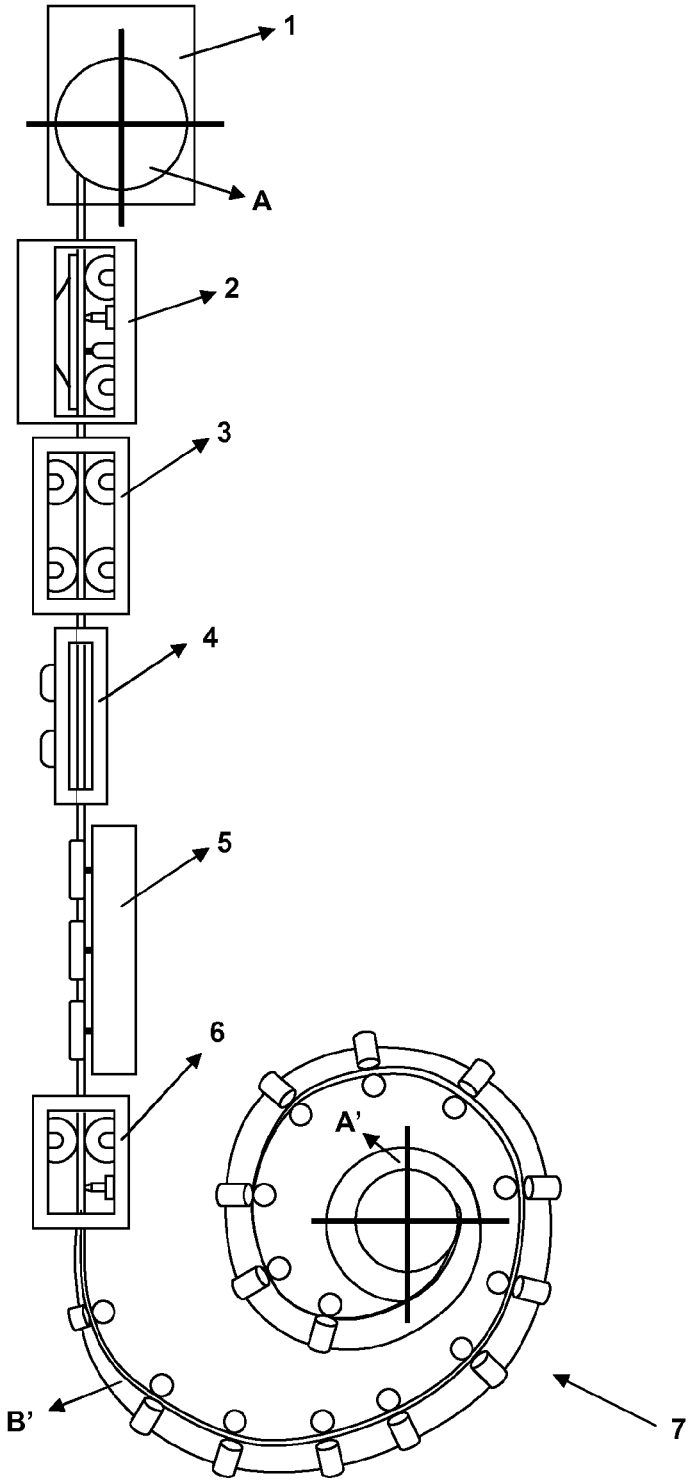
FIG. 1 is a top illustration of a system in which is used a first production stage of the tower production method developed according to the present invention.

The parts in said figures are individually referenced as following.

coil (A)
conical coil (A')
web of unprocessed sheet metal (B)
web of bent sheet metal (B')
larger surface (B1)
width of sheet metal (w)
shorter edge (B2)
longer edge (B3)
radius line segment (d)
tower (C)
winding angle (α)
tangential line (K)
central bending axis (T)
unwinding unit (1)
vertical cutting and joining unit (2)
press unit (3)
sand blasting unit (4)
vertical bending unit (5)
edge cutting unit (6)
accumulator (7)
winding machine (8)

DESCRIPTION OF INVENTION

As differing from the tower production methods according to the prior art, the tower production method developed with the present invention comprises a first production stage, in which a coil (A) of an unprocessed sheet metal (B) is made planar; and the planar sheet metal (B) is bent at the lateral direction so as to yield a bent sheet metal (B') and is wound into a conical coil (A'); and a final production stage (C), in which a conical coil (A') is unwound and is wound and joined in the form of a conical spiral (C) to produce a tower (C). The first production stage in which the sheet metal (B) is bent and brought into a conical coil (A') is preferably conduced at a production facility. The produced conical coil (A') is then transported to the site where the tower (C) is to be erected and is wound at that site to give a tower (C). Since the load is uniformly distributed at the joining edges of the wound sheet metal (B') in a conical spiral tower (C) formed in this way, the mechanical strength of the tower is increased and a tower (C) is produced with high mechanical strength by making use of sheet metals (B) even with a lower thickness.

Figure 3:
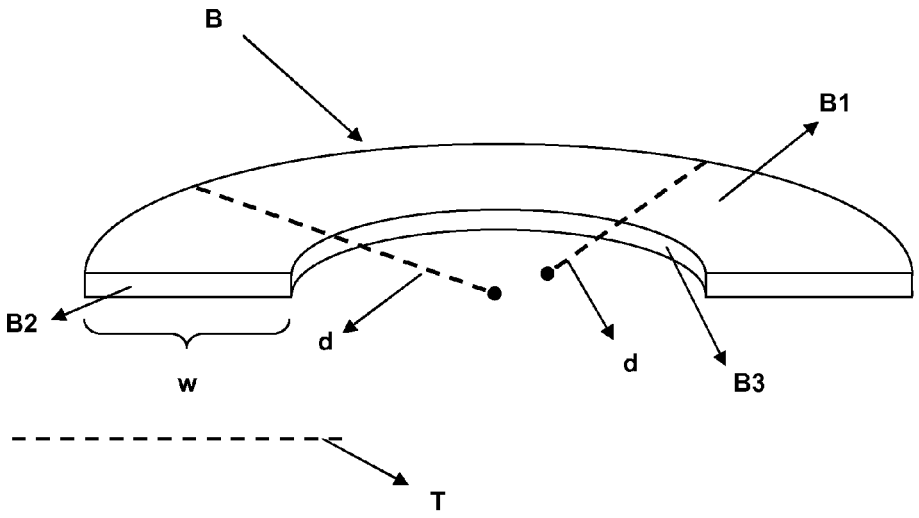
FIG. 3 is a perspective illustration of a bent sheet metal employed in a tower obtained by means of the tower production method developed according to the present invention.

According to the method developed, the sheet metal (B) is bent at the lateral direction, as illustrated in FIG. 3. With this bending process, the sheet metal (B) is brought into an arc with a constant or variable radius. When the sheet metal (B) is bent with a constant radius, a cylindrical pipe is produced with the resulting bent sheet metal (B'). A conical structure can be formed with the use of a bent sheet metal (B') by changing the bending radius. The operations of forming a cylindrical pipe and conical structure is performed by winding a sheet metal (B') which is bent with a proper radius with respect to a constant axis. This winding operation can be conducted at a winding radius that differs from the bending radius of the bent sheet metal (B'). Thus, tubular and/or conical structures with different inlet widths can be produced.

In said bending operation, when the sheet metal (B) is wound, it is bent so that a conical spiral tower is formed. Since the spiral pitch in the conical spiral is constant, bending a sheet metal with a constant shorter edge (B2) to form a conical spiral produces a conical structure in which the longer edges (B3) of the sheet metal (B) abut one over the other so that no gap remains there between. In order to form a conical spiral, the bending equation (f) of the sheet metal (B) bent on the lateral direction will preferably be as follows:

$$K(t) = \frac{ar\sqrt{4 + a^2t^2 + r^2(2 + a^2t^2)^2}}{[1 + r^2(1 + a^2t^2)]^{3/2}} \tag{f}$$

wherein "K(t)" stands for the bending function, "t" for the distance of a point on which a bending operation is conducted to one end of the sheet metal (B), "a" for the angular frequency, and "r" for the radius of the spiral (base of the tower). Since the edges (B3) of the sheet metal (B) are bent so as to be closed over themselves in producing a tower (C), the angular frequency (a) will be indirectly proportional to the width of the sheet metal (w). The spiral radius (r) in turn is equal to the lower radius of the tower (C). Thus, the bending radius (d) is determined with this equation (f) and the sheet metal (B) is bent at the lateral direction so as to form a conical spiral, i.e. the tower (C).

FIG. 1 is a top illustration of a production band on which the first production stage of the production method according to the present invention is implemented. The first production stage of the method developed according to the present invention can also comprise at least one of the following operations:

- Signing the sheet metal: after the coil (A) is unrolled in an unwinding unit (1) and brought into a planar sheet metal (B) and/or after another step of this method, a sign is provided on the sheet metal (B) preferably on the upper side (B1) thereof. This signing operation can be used in checking if the sheet metal (B) has the correct geometry while it is shaped.
- Sign check: The signing operation conducted on the sheet metal (B) is preferably detected by means of at least one sign detector (not illustrated in figures). Thus the geometry of the sheet metal (B) is checked and if necessary, its geometry is corrected through additional production stages.

Joining operation: Since a limited amount of sheet metal (B) is wound around the coil (A) used in production, it may become necessary to join together more than one coil (A) in producing large-size towers. In order to ensure the production continuance, the sheet metals (B) are joined to each other at their shorter edges successively at the vertical direction by means of a vertical cutting and joining unit (2), and the total length of the sheet metal (B) is increased to yield the required size of the sheet metal (B).

Figure 4:
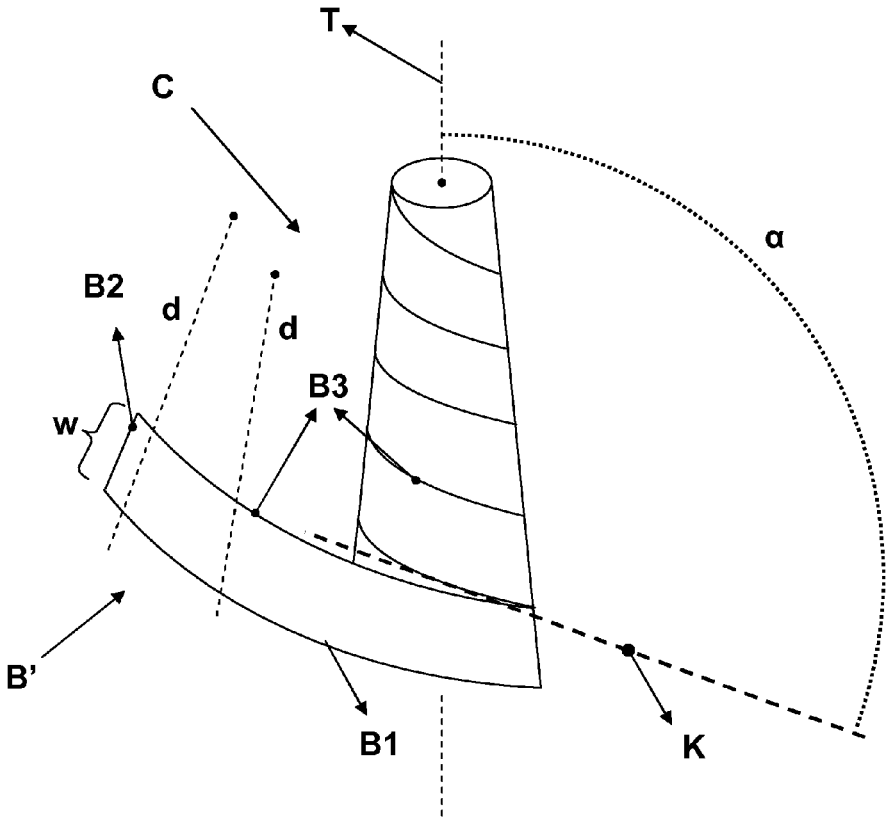
FIG. 4 is a perspective illustration of a semi-finished tower obtained by means of the tower production method developed according to the present invention.

Edge cutting operation: In order to cut away any defected edges from the sheet metal, which are already present or occur on the edges of the sheet metal (B) after the bending operation, the longer edge (B3) of the sheet metal is cut linearly by means of an edge cutting unit (7) (at a direction which is tangential to the edge of the sheet metal) (see FIGS. 3 and 4). Thus, the edges making up the joining points of the sheet metal (B) are smoothed so that the following joining operation can be conducted in an unproblematic manner.

Weld pool production operation: A welding operation is widely used for joining the components of a tower in the production of the same. So, weld pools are produced at the edges of the sheet metal (B) for the welding operation. For this reason, the weld pools are produced at the edges of the sheet metal (B) by making use of a welding groove producing unit (not illustrated in figures) in the method according to the present invention.

Sand blasting operation: A sand blasting unit (4) is used to remove any roughness on the surface of the sheet metal (B) to increase the surface resistance of the same, as well as to prepare the same to a painting operation, so that at least one wider surface (B1) of the sheet metal (B) is subjected to the sand blasting operation.

Painting operation: The sheet metal (B) is preferably painted to provide protection against external influences. The sheet metal (B) is protected against external influences and particularly against corrosion with the painting operation.

Drying operation: In order to shorten the drying time of the paint applied to the sheet metal (B), preferably at least one drying unit (not illustrated in figures) is used to perform a drying operation. The drying operation facilitates the painting operation and allows production to continue at a high rate.

The bent sheet metal (B'), having underwent the first production stages, is preferably wound around an accumulator (7) before it is wound around the conical coil (A'). The accumulator (7) allows for subjecting the sheet metal (B') to any of a plurality of operations while it is in a stationary state, before it is wound around the coil (A'). The painting and drying operations, for instance, can be conducted at the accumulator (7) with manpower while the sheet metal (B') is wound around the accumulator (7). Additionally, the accumulator (7) allows space to be saved at the site of production.

In the first production stage of the method developed according to the present invention, the sheet metal (B) can either be processed horizontally (the wider surface (B1) thereof being parallel to the ground), or vertically (the wider surface (B1) thereof being now vertical to the ground). The vertical operation has various advantages over the horizontal one. One of these advantages is that the welding operation to join two sheet metals (B) is performed more easily as compared to the other case. The most significant difference between the horizontal and vertical operations is that the bent sheet metal (B') is moved at the vertical or horizontal direction on the production band following the bending operation. In this context, the space required to keep the bent sheet metal (B') within the site of production is arranged either vertically or horizontally. When a vertical production is conducted, however, the sheet metal is brought close to the horizontal with a small angle following the bending operation so that the space in which the sheet metal is kept is reduced. In this tilting operation, as exemplified in FIG. 1, the sheet metal (B') can be brought to various angular positions with respect to the ground and kept at an angular accumulator (7).

After the sheet metal (B) is first bent and then wound in the first production stage into a conical coil (A'), it is transported to the site where the tower (C) is to be erected (and where the final production stage is implemented). This transportation operation is conducted both easily and inexpensively, since the bent sheet metal (B') is wound into a conical coil form (A').

Figure 2:
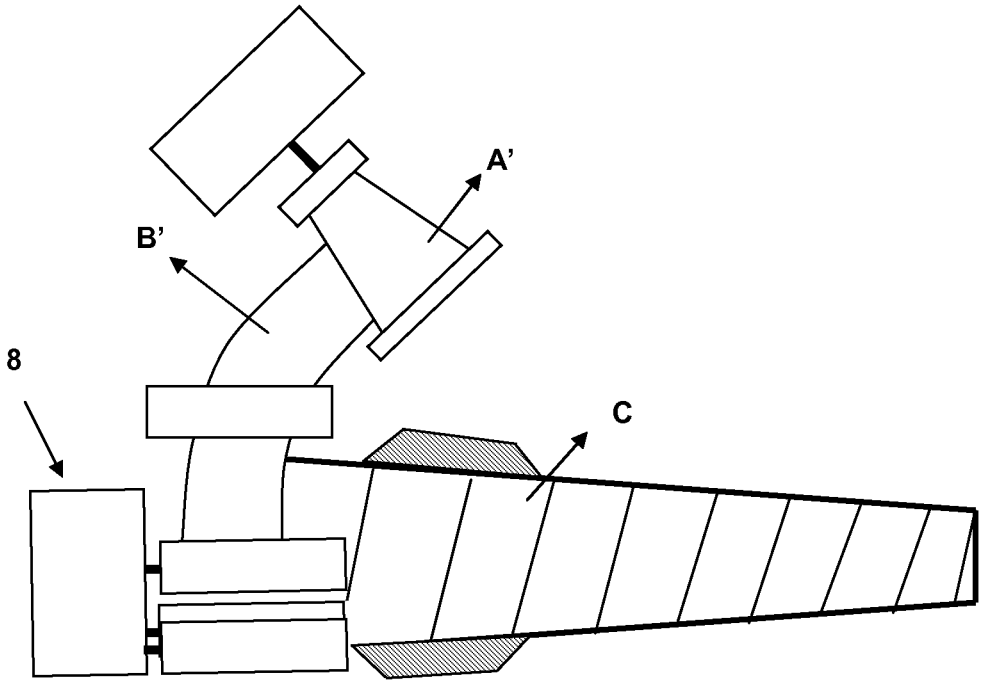
FIG. 2 is a top illustration of a system in which is used a final production stage of the tower production method developed according to the present invention.

FIG. 2 is a top illustration of a production band on which the final production stage of the production method according to the present invention is implemented. In the final production stage, which is preferably performed at the site of erection, the conical coil (A') is unwound and the unwound sheet metal (B') is fed into a winding machine (8). The sheet metal (B') is wound in the winding machine (8) so that a conical tower (C) structure is produced, i.e. so that the longer edge (B3) of the sheet metal is joined over itself in an side-by-side fashion. This winding operation can be made at an initial winding radius that differs from the bending radius of the sheet metal (B') being wound. In the sheet metal (B) being wound, the superimposed longer edges (B3) are fixed to each other by means of welding at the weld pools produced during the first production stage. Thus, a single-piece continues sheet metal (B') is used to produce a tower (C). This sort of tower (C) production is therefore a continuous type of production since a continuous sheet metal (B) is used. An illustration of a semi-finished (semi-wound) tower (C) wound by this operation is given in FIG. 4. In winding the tower (C), the angle ($\alpha$) of the longer edge (B3) of the sheet metal (B') with respect to the axis of winding (T), i.e. the angle ($\alpha$) of any straight line (K) that is tangential to the longer edge (B3) of the sheet metal (B') to the axis of winding (T) is kept constant.

In said winding operation, the sheet metal must be fed into the winding machine (8) from a correct position to result in a correctly-wound tower (C). Since the radius of a sheet metal (B') being wound is varying especially in winding a conical tower, its position with respect to the winding machine (8) can change. For this reason, in a preferred embodiment according to the present invention, the position of the sheet metal (B') by which it is fed to the winding machine (8) can be adjusted on the horizontal and vertical axes, as well as angularly, to conduct the winding operation in a correct manner.

In an alternative embodiment of the present invention, a tower (C) may be in the form of joining more than one sheet metal (B') end-to-end from their shorter edges (B2) and winding the same. Particularly if a high tower (C) is to be formed, the amount of sheet metal (B') wound around a single conical coil (A') may not be adequate to form the entirety of the tower (C). In this case, after all of a sheet metal (B') provided on a conical coil (A') is fed to the winding machine (8), the next conical coil (A') is taken and the sheet metal (B') thereon (A') is unwound and at least one shorter edge (B2) thereof is joined to at least one shorter edge (B2) of the former sheet metal (B') wound in the winding machine (8). This fixation operation is preferably performed via welding. The thickness of sheet metals (B') joined end-to-end can preferably be different as required by the size and shape of a tower (C) produced.

With the production method developed according to the present invention, the first shaping and conditioning operations of a sheet metal (B) to produce a tower (C) are performed at a production facility (plant) and the sheet metal (B) is thus brought into a conical coil (A'), so that the material to make a tower (C) can be kept at a very small volume and be transported in this form to the site of erection. Then, the final production stage is easily performed at the site by making use of this conical coil (A'). Thus, the number of equipment and operations required at the site are minimized. Additionally, since a continuous sheet metal (B) is bent and used in this manner, any waste material to occur from the sheet metal (B) as it is cut is likewise minimized.

The invention claimed is:

1. A tower production method, characterized by comprising a first production stage, including the steps of:

unrolling and bringing into a planar state a sheet metal (B) wound around a coil (A), bending the planar sheet metal (B) at the lateral direction at varying bending radii (d), creating a bent sheet metal (B') and winding the bent sheet metal (B') in the form of a conical coil (A');

transporting the conical coil (A') to a site of final production, after the sheet metal (B) is first bent and then wound in the first production stage in the form of a conical coil (A');

and a final production stage, including the steps of:

feeding the bent sheet metal (B') unwound from the conical coil (A') to at least one winding machine (8), producing a tower (C) by bending and winding the bent sheet metal (B') in the winding machine (8) around a central bending axis (T) substantially parallel to a wider surface (B1) thereof of the sheet metal so that a defined initial predetermined starting winding radius and the angle between a longer edge (B3) thereof of the bent sheet metal (B') and the central bending axis (T) are kept substantially constant and a longer edge (B3) of the bent sheet metal (B') is joined over itself to produce a tower (C) with the other longer edge (B3) of the bent sheet metal (B').

2. The tower (C) production method according to claim 1, characterized in that the first production stage comprises the step of joining one sheet metal (B) to another sheet metal (B), so that the shorter edges (B2) thereof extending along the width (w) of the sheet metals (B) are welded to each other end-to-end.

3. The tower (C) production method according to claim 1, characterized in that the first production stage comprises the step of cutting at least one longer edge (B3) of the bent sheet metal (B') linearly tangentially to said longer edge (B3) of the bent sheet metal (B') to smooth said longer edge (B3).

4. The tower (C) production method according to claim 1, characterized in that the first production stage comprises the step of producing weld pools on at least one longer edge (B3) of the sheet metal (B).

5. The tower (C) production method according to claim 1, characterized in that the first production stage comprises the step of sand blasting the bent sheet metal (B') after the sheet metal (B) is subjected to the bending operation.

6. The tower (C) production method according to claim 5, characterized in that the first production stage comprises the step of painting the bent sheet metal (B') following the sand blasting operation.

7. The tower (C) production method according to claim 1, characterized in that the first production stage comprises the step of winding the bent sheet metal (B') around an accumulator (7) before the bent sheet metal (B') is wound into a conical coil (A').

8. The tower (C) production method according to claim 1, characterized in that the position of the bent sheet metal (B') with respect to the winding machine (8) is changed according to different bending radii, in the step of feeding the bent sheet metal (B') to the winding machine (8) in the final production stage.

9. The tower (C) production method according to claim 1, characterized in that the final production stage comprises the step of joining one bent sheet metal (B') to another bent sheet metal (B'), so that the shorter edges (B2) of the bent sheet metals (B') are welded to each other end-to-end.

10. The tower (C) production method according to claim 9, characterized by comprising a step of joining together bent sheet metals (B') with different thicknesses by means of welding them end-to-end.

11. The tower (C) production method according to claim 1, characterized in that the sheet metal (B) is processed substantially vertically with the wider surface thereof being vertical to the ground before bending in the first production stage and then the bent sheet metal (B') is tilted following the bending operation.

* * * * *